United States Patent [19]

Ridley

[11] 4,135,477

[45] Jan. 23, 1979

[54] CURTAIN COATING APPARATUS

[75] Inventor: Kenneth A. Ridley, Brentwood, England

[73] Assignee: Ciba-Geigy AG, Basel, Switzerland

[21] Appl. No.: 772,335

[22] Filed: Feb. 25, 1977

Related U.S. Application Data

[63] Continuation-in-part of Ser. No. 615,340, Sep. 22, 1975, abandoned.

[51] Int. Cl.[2] ..... B05D 1/30; G03C 3/00

[52] U.S. Cl. ..... 118/325; 96/68; 118/DIG. 4; 427/420

[58] Field of Search ..... 118/DIG. 4, 324, 325; 96/68; 427/420

[56] References Cited

U.S. PATENT DOCUMENTS

| | | | |
|---|---|---|---|
| 3,365,325 | 1/1968 | Fraenkel et al. | 118/DIG. 4 |
| 3,508,947 | 4/1970 | Hughes | 118/DIG. 4 |
| 3,632,403 | 1/1972 | Greiller | 118/DIG. 4 |
| 3,717,121 | 2/1973 | Bruckbauer et al. | 118/324 |
| 3,867,901 | 2/1975 | Greiller | 118/325 X |
| 4,019,906 | 4/1977 | Ridley | 118/325 X |

FOREIGN PATENT DOCUMENTS

| | | | |
|---|---|---|---|
| 2448440 | 4/1975 | Fed. Rep. of Germany | 427/420 |
| 1429260 | 3/1976 | United Kingdom | 118/DIG. 4 |
| 272844 | 3/1970 | U.S.S.R. | 118/DIG. 4 |

*Primary Examiner*—Louis Rimrodt

[57] ABSTRACT

An apparatus for curtain coating is provided wherein a falling curtain of coating liquid is formed by causing coating liquid to flow as a layer down an inclined surface of a slide hopper, the inclined surface terminating in a lip and the coating liquid beginning its fall after flowing over the lip on to a travelling web positioned beneath the slide hopper and being coated thereon as a layer. The slide hopper is provided with two vertical edge guiding plates extending parallel to the direction of web motion and being of such width to allow the curtain edge to follow its natural inflected path. Preferably the edge guiding plates are composed of an easily wettable material, particularly polymethymethacrylate.

5 Claims, 5 Drawing Figures

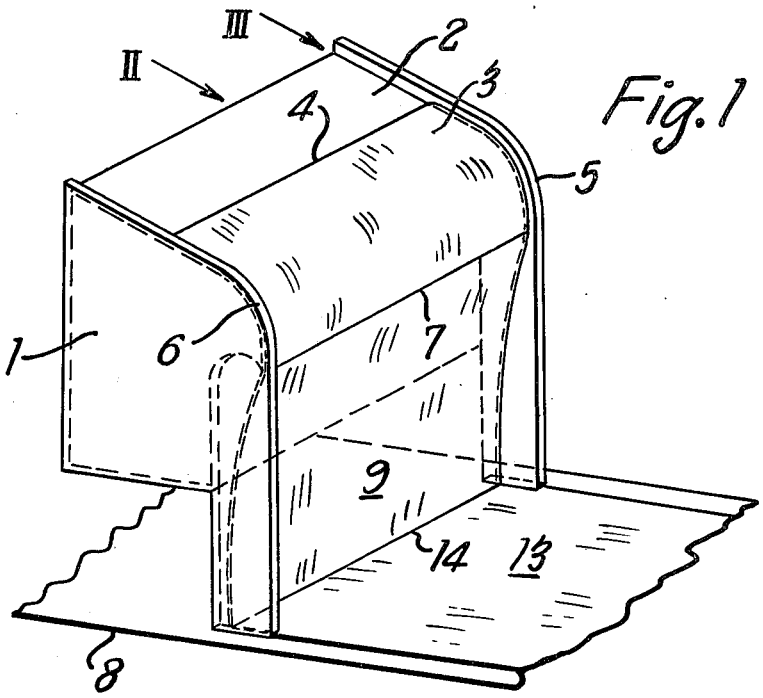
Fig. 1
Fig. 2
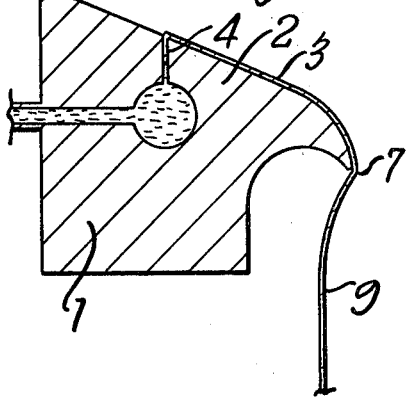
Fig. 3
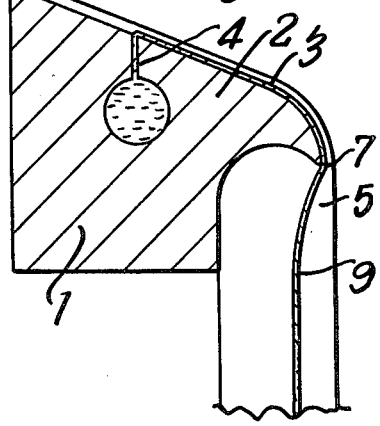

CURTAIN COATING APPARATUS

This application is a continuation-in-part of my U.S. Patent Application Ser. No. 615,340 filed Sept. 22, 1975, now abandoned.

This invention relates to curtain coating apparatus for coating travelling web material.

In one method of producing a coating on web material by the curtain coating process, a layer of coating liquid is formed on an inclided slide. The layer of coating liquid flows down the slide and is then allowed to drop off the end of the slide as a free falling curtain. This curtain falls on to a travelling web positioned beneath the inclined slide and is coated thereon as a layer. This method has been extended to allow several layers of coating liquid to form a multilayer on the inclined slide and to allow this multi-layer to fall as a multi-layer free-falling curtain to form a multi-layer coating on the travelling web.

In British Patent No. 1,276,381, such a method is described as well as apparatus for performing the method. In the apparatus, edge guides are positioned at each side of the curtain to maintain the curtain at the desired width during the free fall. The edge guides shown in the specification are thin rods or wires. Edge guides of this type constrain the curtain to fall vertically in the vicinity of the guides. However, in the central region of the curtain, away from the influence of the edge guides, the curtain does not leave the tip of the inclined slide hopper in a vertical plane. This is because of the Coanda effect (often called the "teapot effect") in which a liquid flowing over a surface experiences forces causing it to cling to that surface. (See "Teapot Effect", J. B. Keller, Journal of Applied Physics, Vol. 28, No. 8 1957, pp. 859–864.) Thus, the liquid layer or layers leave the tip of the slide surface with a horizontal component of velocity inwardly toward the slide hopper. The major part of the curtain falls in a slightly curved trajectory, the curvature depending on the viscosity and flow rate of the liquid, while at the edges of the curtain the fall is vertical, being constrained by the edge guides. The result is a distortion of the curtain which leads to a deviation from a straight coating line at the coating zone on the web. This deviation tends to cause coating marks on the coated web.

It is the object of the present invention to provide an apparatus for curtain coating using a slide hopper coating apparatus wherein the tendency to form coating marks caused by the edge guides is minimized.

According to the present invention, in an apparatus for curtain coating wherein a falling curtain is formed by causing coating liquid to flow as a layer down an inclined surface of a slide hopper coating apparatus, the inclined surface terminating in a lip and the coating liquid beginning its fall after flowing over the lip, the provision of vertical edge guiding plates extending parallel to the direction of web motion and being of such width to allow the curtain edge to follow its natural inflected path.

Preferably the material of the edge guiding plate is of an easily wettable material, for example, polymethymethacrylate sheet.

The width of the edge guiding plate must be sufficient to prevent the curtain edge from overlapping either side of the plate. For example, to accommodate flow rates between 0.5 and 3 ccs. per second per centimeter width and viscosities between 10 and 100 centipoises, the width of the edge guiding plates, that is to say, their dimension which extends parallel to the direction of web motion, is preferably at least 1 inch (2.6 cms).

The accompanying drawings will serve to illustrate the invention. In the drawings:

FIG. 1 is a perspective view of a curtain coating apparatus of the slide hopper type showing the edge guiding plates;

FIG. 2 is a cross-section through the apparatus of FIG. 1 along the line II;

FIG. 3 is a cross-section through the apparatus of FIG. 1 along the line III;

Figure 4:
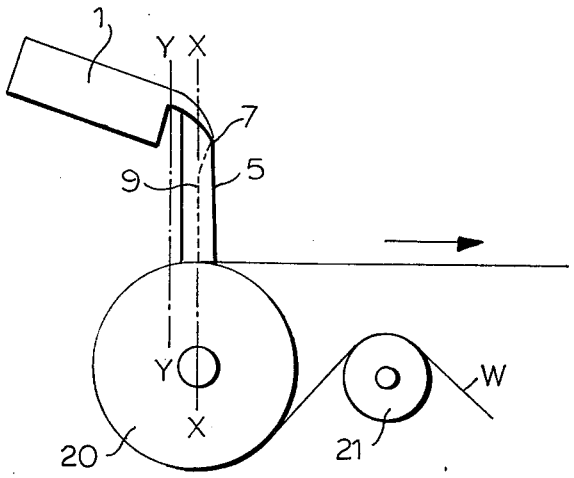
Figure 5:
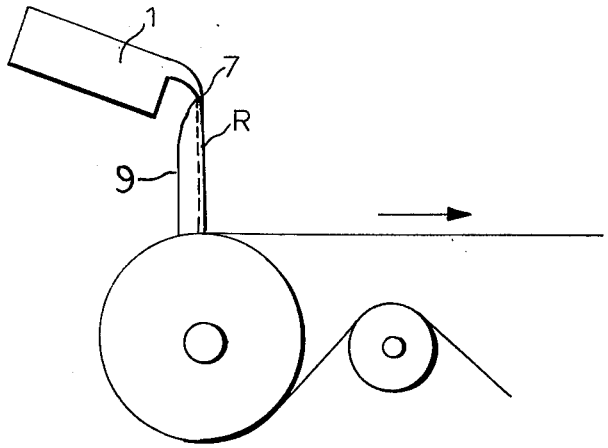
(PRIOR ART) FIG.5

FIG. 4 is a diagrammatic side elevation view of how the invention is used in a device for coating a travelling web; and FIG. 5 is a diagrammatic side elevation view similar to FIG. 4 showing a prior art arrangement. In FIG. 1, a slide hopper 1 comprises an inclined slide surface 2 down which a coating liquid 3 slides as a layer across its width. The coating liquid 3 issues from a slot 4 which extends across the slide hopper. On each side of the inclined surface 2 is an edge guide 5 and 6. Each of the edge guides 5 and 6 extend downward beyond the end of the slide hopper 1 and 2 as far as the support being coated, or in the case where the width of the curtain exceeds the width of the support, they may extend to below the travelling web of material 8. The coating liquid 3 slides down the inclined surface 2 until it reaches the tip of the slide hopper 7. Thereafter, it falls as a free falling curtain 9 until it reaches the travelling web 8 positioned therebeneath at the coating line 14. The coating liquid 3 is then carried away as a coated layer 13 on the web 8. The presence of the edge guides 5 and 6 causes the curtain to maintain its full width from the tip 7 of the slide hopper 1 until it reaches the travelling web 8.

In the apparatus shown in FIG. 1, the width of the slide hopper 1 is 40 inches and the vertical height of the falling curtain of liquid, that is to say, from the tip 7 to the web 8 is 5 inches. The width of each edge guide 5 and 6 at point 10 in the direction of travel of the web 8 is 1 inch. The effect of having such wide edge guides is shown in FIGS. 2 and 3 which follow.

FIG. 2 is a section through FIG. 1 in II. In this figure, the numbers have the same signification as in FIG. 1. The coating liquid 3 is shown issuing from the slot 4 and sliding down as a layer on the inclined surface 2 of the slide hopper 1. When the layer of coating liquid 3 reaches the tip 7 of the slide hopper 1 instead of falling vertically, it falls in a curved path to begin with, due to the Coanda effect.

In FIG. 3 there is shown a cross-section of the apparatus of FIG. 1 along the line III. This line is at the junction between the edge of the slide hopper and the edge guide 5. In this figure there is shown the coating liquid 3 issuing from the slot 4 and falling as a layer down the inclined surface 2 on the slide hopper 1. As shown in this figure, the liquid, when it leaves the tip 7, falls in a curved path initially, even though the edge of the curtain of the liquid touches the edge guide 5.

If the edge guide instead of being a comparatively wide guide was merely a thin straight vertical rod, the path of the edge of the falling curtain of liquid would have been completely vertical. This would have distorted the line of the liquid in the coating zone and would have produced coating marks. However, in the apparatus shown in FIGS. 1–3, the coating line 14 is substantially normal to the direction of motion of the web, and this minimizes the possibility of coating faults occurring.

The apparatus of the invention is particularly useful in the photographic industry for forming films on travelling webs.

FIGS. 4 and 5 show diagrammatically a slide hopper 1 located over a travelling web W, the web being supported at the coating zone by a coating roller 20, and being guided to the coating roller over a guide roller 21.

Experiments with the curtain method have shown that in order to obtain the high standard of coating quality demanded in the photographic industry, the line of impact of the curtain should coincide with, or be very close to, the top dead center of the coating roller 20 supporting the film web in the coating zone. Referring to FIG. 4, if the line of impact deviates to the right of the ideal position at the intersection of axis X with the periphery of the roller, coating occurs on an unsupported portion of web W and the coating will be uneven due to web vibration. If the line of impact is moved to a position at the intersection of axis Y with the periphery of the roller, the angle between the falling curtain 9 and the travelling web W can become sufficiently oblique for the curtain to "skid" on a boundary layer of air and so fail to wet the web W. In this case, coating "skips" and other non-uniformities arise. The limiting position Y depends on flow rate, coating speed and roller diameter, but typically is only about 10 mm from axis X.

Where, as in the prior art apparatus shown in FIG. 5, the edges of the curtain 9 are constrained only by wires R, the curtain 9 makes a curved line of impact on the web, there is a corresponding reduction in the acceptable range over which the coating device 1 may be positioned relative to the coating roller 20. If the curvature of the impact line is too great, good coating is not possible, because some part at least of the curtain width will fall on the web at a position outside the range XY. This is illustrated by comparing FIG. 5 with FIG. 4. If the curtain edges are made to fall along line X, the curtain center may fall at, or to the left of, line Y.

However, employing the coating apparatus of the present invention, in which a straight line of impact at the coating zone is obtained with the arrangment shown in FIG. 4, the lip of the coating device can be placed significantly to the right of line X in order to cause the substantially straight line of impact to occur between the limits X and Y. This is because, due to the Coanda effect, the curtain does not fall vertically from the lip of the coating device onto the web to be coated. A suitable position is readily found, however, appropriate to a useful range of practical conditions. Thus, the coating faults caused by the distorted coating line obtained when using the prior art wire edge guide R are overcome by using the flat, wide edge guides 5 of the present invention.

What is claimed is:

1. An apparatus for curtain coating, comprising: a coating hopper having an inclined surface terminating in a lip, the hopper further having a slot extending thereacross and opening into the inclined surface; a feed system coupled to said hopper for supplying a coating liquid through the slot to the inclined surface, the liquid issuing from the slot flowing as a layer down the inclined surface and beginning its fall after flowing over the lip and thereby forming a free-falling liquid curtain; a transport means for moving a web to be coated beneath the coating hopper; and two vertical edge guiding plates extending from the opposite ends of said lip to said web and having the opposed surfaces thereof parallel to the direction of movement of the web and having a dimension in said direction greater than the distance the liquid curtain will deviate from a vertical line from the lip due to the Coanda effect of the lip on the liquid for permitting the entire curtain including the edges thereof to follow its natural path to the web and causing the curtain to come in contact with the web along a straight transverse line thereacross.

2. The apparatus as set forth in claim 1 wherein the edge guiding plates are composed of an easily wettable material, particularly polymethymethacrylate sheet.

3. The apparatus as set forth in claim 1 wherein the width of the edge guiding plates is at least 1 inch.

4. The apparatus as set forth in claim 1 wherein the coating hopper is a multi-layer coating hopper.

5. An apparatus for curtain coating comprising: a coating hopper having an inclined surface terminating in a lip, the hopper further having a slot extending thereacross and opening into the inclined surface; a feed system coupled to said hopper for supplying a coating liquid through the slot to the inclined surface, the liquid issuing from the slot flowing as a layer down the inclined surface and beginning its fall after flowing over the lip and thereby forming a free-falling liquid curtain; a transport means including a supporting roll beneath said hopper and around which a web to be coated extends and is supported at the top dead center thereof and extending away from the top dead center of said roll; and two vertical edge guiding plates extending from the opposite ends of said lip to said web and having the opposed surfaces thereof parallel to the direction of movement of the web and having a dimension in said direction greater than the distance the liquid curtain will deviate from a vertical line from the lip due to the Coanda effect of the lip on the liquid for permitting the entire curtain including the edges thereof to follow its natural path to the web and causing the curtain to come in contact with the web along a straight transverse line thereacross, said lip being horizontally offset from said top dead center of said roll a distance corresponding to the distance said liquid curtain will deviate from a vertical line during its fall from the lip to the roll, whereby the curtain will contact the web substantially at the top dead center of said roll.

* * * * *